US008734048B1

(12) United States Patent
Driskell et al.

(10) Patent No.: US 8,734,048 B1
(45) Date of Patent: May 27, 2014

(54) CONTINUOUS FLEXIBLE RETRO-REFLECTIVE ROADWAY MARKING DEVICE

(71) Applicant: Driskell Holdings LLC, St. Johns, FL (US)

(72) Inventors: Gregory Wayne Driskell, St. Johns, FL (US); Michael David Green, Chesterfield, MO (US)

( * ) Notice: Subject to any disclaimer, the term of this patent is extended or adjusted under 35 U.S.C. 154(b) by 0 days.

(21) Appl. No.: 13/958,710

(22) Filed: Aug. 5, 2013

(51) Int. Cl.
*E01F 9/04* (2006.01)
*E01F 9/06* (2006.01)

(52) U.S. Cl.
USPC ..... 404/10; 404/12; 404/16; 116/63 R

(58) Field of Classification Search
USPC ..... 404/10, 12, 13, 14, 15, 16; 116/63 R; 400/612; D10/113.1
See application file for complete search history.

(56) References Cited

U.S. PATENT DOCUMENTS 1,833,124 A * 11/1931 Rand ..... 404/10
3,720,181 A * 3/1973 Elkins ..... 116/63 P
3,971,623 A * 7/1976 Hedgewick et al. ..... 359/531
4,515,499 A * 5/1985 Furiate ..... 404/6
4,618,281 A * 10/1986 Ajemian ..... 404/16
5,230,582 A * 7/1993 Schmitt et al. ..... 404/6
D354,246 S * 1/1995 Weid ..... D10/113.1
D378,857 S * 4/1997 Hale ..... D25/164
5,639,179 A * 6/1997 Jensen ..... 404/6
D400,985 S * 11/1998 Risi ..... D25/164
6,079,898 A * 6/2000 St. Amant, III ..... 404/6
D468,225 S * 1/2003 Tobler ..... D10/111
D541,952 S * 5/2007 Keeley et al. ..... D25/119

FOREIGN PATENT DOCUMENTS

GB 2 086 967 * 5/1982
JP 6-16167004 * 6/1994

* cited by examiner

*Primary Examiner* — Gary Hartmann
(74) *Attorney, Agent, or Firm* — Mark Young, P.A.

(57) ABSTRACT

A passive elongated flexible roadway marking device attaches and conforms to a curved roadway median. The device includes an integrally formed plastic extruded spline and a protrusion having a D-shaped profile. Notches with stress relief vertices are provided in a flange of the spline to facilitate bending. Attachment holes are provided in each flange of the spline, in an alternating arrangement. Spaced apart retro-reflective tape strips are applied to the curved outer surface of the protrusion. A pressure sensitive adhesive on the bottom of the spline facilitate installation. A coupling connects several units.

18 Claims, 8 Drawing Sheets

CONTINUOUS FLEXIBLE RETRO-REFLECTIVE ROADWAY MARKING DEVICE

FIELD OF THE INVENTION

This invention relates generally to roadway marking, and, more particularly, to a roadway marking device that (a) includes spaced apart retro-reflectors configured to reflect light from any approaching vehicle at any angle of incidence and (2) bends to conform to straight and curved surfaces.

BACKGROUND

Roadway safety requires delineating travel lanes from curbing and other structures that may protrude into a roadway. Currently, retro-reflectors are mounted to guide rails or dedicated vertical support structures to help motorists identify a median or other structure. Frequently the retro-reflectors are substantially planar small devices that are responsive to incident light within a limited range of heights and directions. Problematically, such reflectors are frequently damaged, knocked out of position or completely knocked over, leaving the median or structure unmarked for motorist safety. Even when properly erected, the retro-reflector may be positioned a distance from a curb, making the curb structure difficult for a motorist to see at night.

Currently there is no device that is designed specifically to visually delineate the travel lanes from the curbing and other structures protruding into the vehicular travel way. The device should be conformable to various structures, easy to install, secure, and capable of reflecting light to any approaching vehicle.

The invention is directed to overcoming one or more of the problems and solving one or more of the needs as set forth above.

SUMMARY OF THE INVENTION

To solve one or more of the problems set forth above, in an exemplary implementation of the invention, a passive elongated flexible roadway marking device that is attachable to a roadway median provides retro-reflectivity to any approaching vehicle includes an elongated spline having a first side, an opposite second side, a first end and an opposite second end, a top surface and an opposite bottom surface, a spline length from the first end to the second end, a spline width from the first side to the second side, and spline thickness from the top surface to the bottom surface. A protrusion is attached to the top surface of the spline. The protrusion has an outer surface, a profile shape (e.g., a D-shaped profile including a semicircular profile portion attached to a straight profile portion), a protrusion length, a protrusion width and a protrusion height. The protrusion width is less than the spline width and the protrusion height is at least ½ inch, preferably at least 1-inch and more preferably at least about 1.25 inches. The spline further includes a first flange coextensive with the first side and a second flange coextensive with the second side. The protrusion is attached to the spline between the first flange and the second flange.

A plurality of spaced apart notches are provided in the first flange. The notches facilitate bending of the device. Each of the plurality of spaced apart notches may each be a v-shaped notch with a stress relief vertex, such as a circular stress relief vertex.

A plurality of spaced apart attachment holes are provided in the first flange and the second flange. Preferably, the holes are staggered so that holes of one flange are between holes of the opposite flange.

A plurality of spaced apart retro-reflective elements are attached to the outer surface of the protrusion. Each of the retro-reflective elements covers a portion of the protrusion from about the first flange to the second flange. The retro-reflective elements may be retro-reflective tape strips, such as, but not limited to, ½, 1 or 1½ inch wide abrasion resistant retro-reflective tape strips.

Pressure sensitive roadway attaching adhesive may be attached to the bottom surface of the spline to facilitate installation. After positioned, the marking device may be secured to a median, such as by using masonry screws extending through the attachment holes into the median.

The spline width may be at least 1.5 inches. The protrusion width may be at least 1 inch. The protrusion height may be at least 1 inch. These minimum dimensions help ensure visibility.

The protrusion and spline being integrally formed, such as an integrally formed plastic extrusion. Tape strips and adhesive may then be applied. Notches and holes may then be formed in the flanges.

The protrusion may be hollow, with a channel extending through the protrusion. Several of the devices may be attached together using a coupling, such as male connector shaped and sized to extend into the channel and frictionally engage the protrusion of each of a pair of adjoining units.

BRIEF DESCRIPTION OF THE DRAWINGS

The foregoing and other aspects, objects, features and advantages of the invention will become better understood with reference to the following description, appended claims, and accompanying drawings, where:

DETAILED DESCRIPTION

Figure 1:
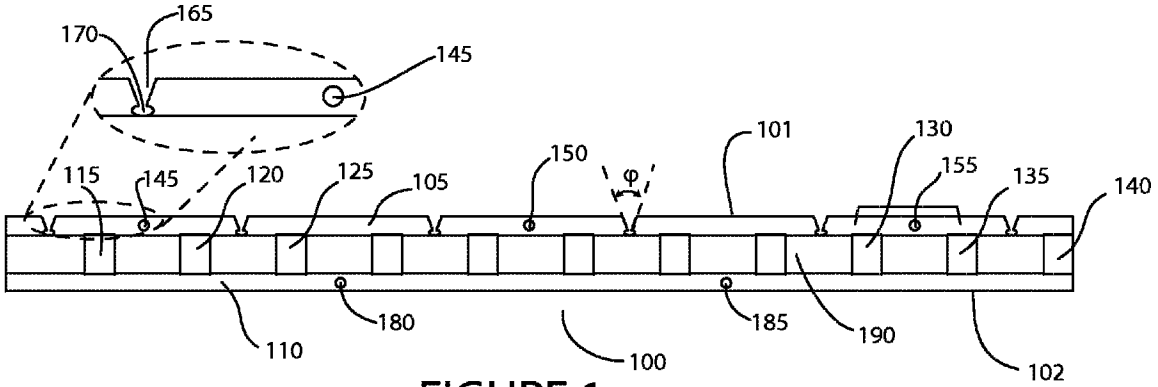
FIG. 1 is a plan view of a continuous flexible retro-reflective roadway marking device according to principles of the invention.
Figure 2:
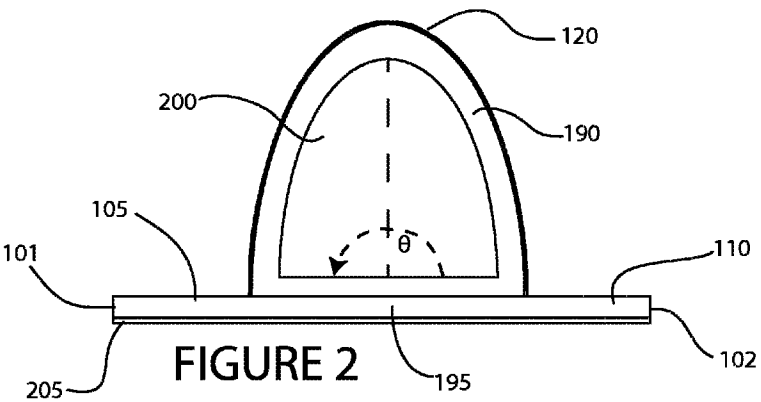
FIG. 2 is a profile view of a continuous flexible retro-reflective roadway marking device according to principles of the invention.
Figure 3:
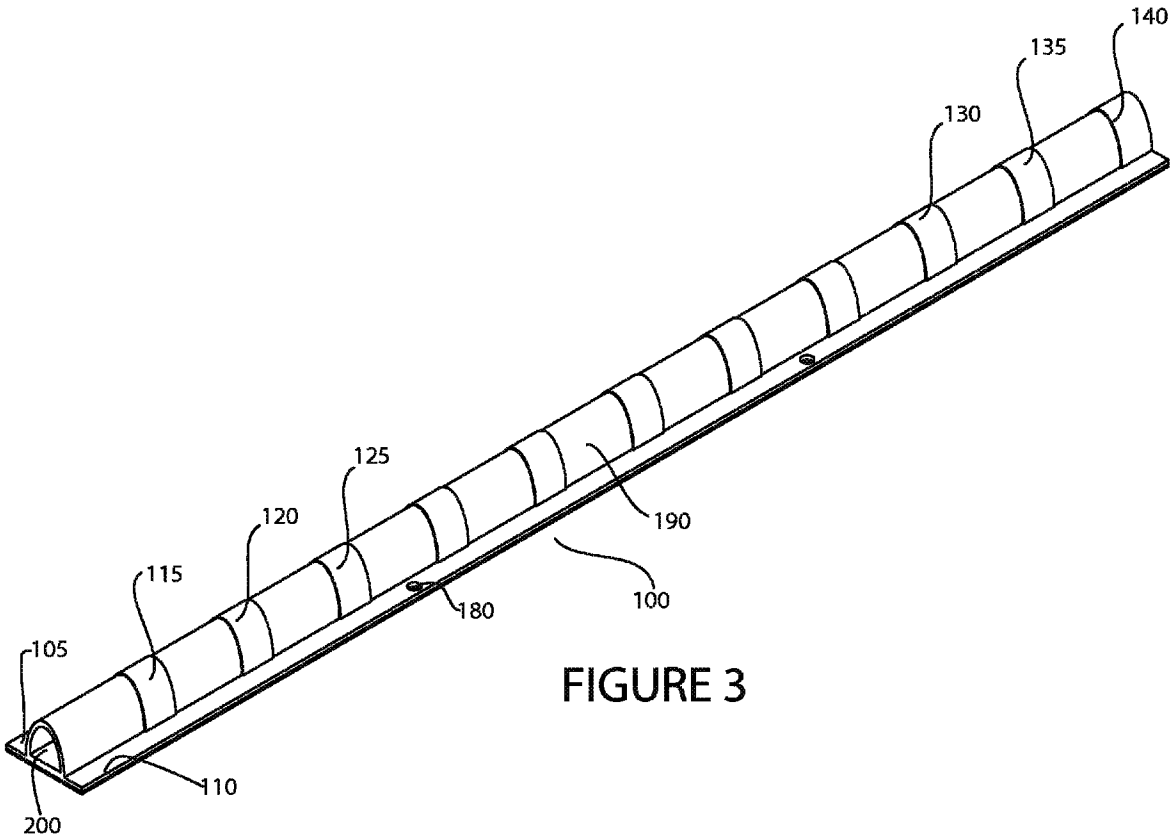
FIG. 3 is a first perspective view of a continuous flexible retro-reflective roadway marking device according to principles of the invention.
Figure 4:
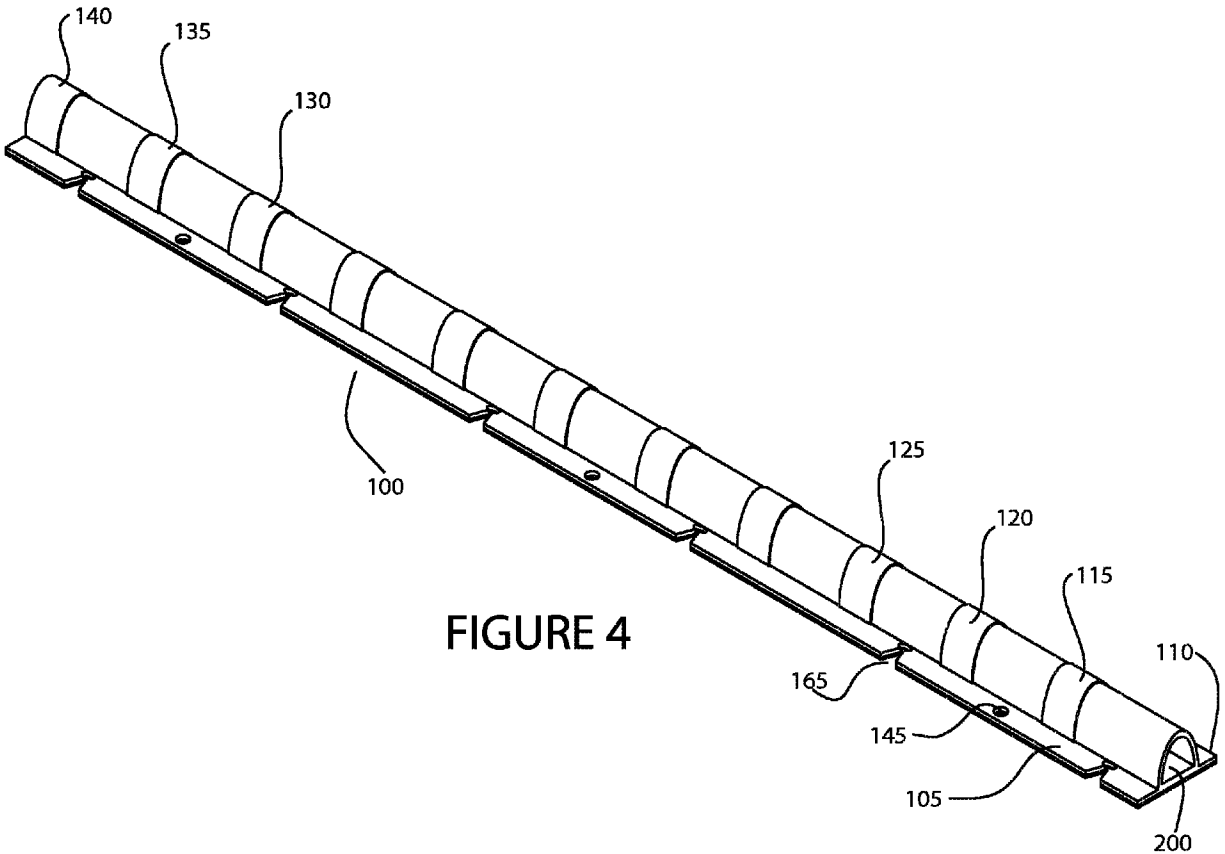
FIG. 4 is a second perspective view of a continuous flexible retro-reflective roadway marking device according to principles of the invention.

Referring to FIGS. 1 through 4, various view of a passive elongated flexible roadway marking device 100 according to principles of the invention are provided. The device 100 is an elongated flexible structure comprised of an elongated flexible plastic spline 195, with a D-shape or similar profile protrusion 190 that is coextensive with the spline 195. While a D-shaped profile is preferred, other profiles having an alternative profile shape that includes a curved or faceted surface extending more than 90 degrees (i.e., $\theta \geq 90°$) may be utilized. As used herein, D-shape includes a profile shape with a linear portion attached to a curved portion. The linear portion has two terminal ends. The curved portion has two terminal ends. One end of a terminal curved portion attaches to one end of a linear portion. The other end of the curved portion attaches to the other end of the linear portion. The curved portion may comprise a smooth curve, an angular arrangement of adjoining segments and/or a faceted curve. The "curved" portion may be C-shaped, U-shaped, V-shaped, semicircular or otherwise arc shaped. A shape with the angle equal or about equal to 180 degrees is preferred. The protrusion height and width are preferably at least about 1 inch and more preferably 1.25 inches in width and height. However, other dimensions, including 0.75 to 3 inches in height and/or width may be utilized within the scope of the invention. The surface of the protrusion 190 supports retro-reflective elements 115-140 that reflects light from nearby, particularly, approaching vehicles, no matter the height of the vehicle or elevation of the approaching roadway relative to the roadway marking device. In the exemplary illustrated embodiment the protrusion 190 is hollow, with a channel 200 extending through the protrusion 190. Light emanating from headlamps of an approaching vehicle will always strike a portion of the device 100, which will include one or more retro-reflective elements 115-140.

The channel 200 serves a few purposes. First, the channel 200 provides a female receptacle suitable for receiving a male connector to join separate units of the device together. Concomitantly, the channel 200, which makes the protrusion 190 hollow, allows the protrusion to collapse when impacted. Thus, for example, when a load is applied, such as when a vehicle passes onto the protrusion 190, the protrusion will collapse. As the protrusion 190 is comprised of a resilient elastomer, it tends to return to its undeformed state after a load is removed.

The spline 195 is a generally rectangular elongated planar flexible strip having a length (l) and a width (w) and a thickness (t). The length, width and thickness may vary. However, a thickness between 0.0625 inches and 0.25 inches, a width between 1.5 to 3 inches (e.g., about 2.5 inches) and a length of a foot or longer are preferred (e.g., 3-feet, 1-meter, 4-feet, 6-feet, 2-meters) may be utilized.

Being wider than the protrusion 190, the spline 195 has side edges that extend beyond the D-shaped protrusion 190, thus providing flanges 105, 110. The flanges 105, 110 include a first flange 105 and an opposite second flange 110. The first flange 105 is an inward flange facing the first side 101, an inward side. The second flange 110 is an outward flange, facing the second side 102, an outward side.

A plurality of spaced apart v-notches 165 with stress relief circular vertices 170 are cut into one of the flanges (e.g., the first flange), along the edge of the flange, to facilitate bending into a curve that conforms to the curvature of a median nose of a traffic median. Each notch 165 may define an acute angle, $\phi$, though larger angles may be utilized within the scope of the invention. In one exemplary embodiment, the v-notches 165 are spaced apart at 6" centers. In this embodiment, the other flange 110 does not include v-notches or slits if the spline 195 is pliable without notches or slits. However, in an alternative embodiment, a plurality of spaced apart slits with stress relief circular vertices may be cut into the other flange (e.g., the second flange), along the edge of the flange, to facilitate bending into a curve that fits flush against a median nose of a traffic median. If slits are provided, they may be formed opposite the v-notches.

A plurality of spaced apart reflective elements 115-140 are provided on the D-shaped protrusion 190. The reflective elements 115-140 conform to the curvature of the curved surface of the D-shaped protrusion 190. The reflective elements 115-140 include a reflective surface that faces outwardly. In an exemplary embodiment, the reflective elements 115-140 comprise strips of retro-reflective tape 115-140 wrapped around sections of the curved D-shaped protrusion 190. In a particular preferred embodiment, the reflective elements 115-140 comprise strips of abrasion resistant retro-reflective tape 115-140 wrapped around sections of the curved D-shaped protrusion 190. By way of example and not limitation, the tape 115-140 may comprise 1-inch wide strips spaced apart at 3-inch centers. Additionally, in a preferred embodiment, the strips of tape 115-140 are arranged so that no strip is directly across (i.e., aligned with) a v-notch. The strips are wrapped around the exposed (i.e., outwardly facing) side of the protrusion 190 to provide retro-reflectivity along both sides 101, 102 of the device 100. The color of the tape 115-140 may vary to meet requirements and preferences. The spaced apart strips of tape 115-140 cover all or substantially all of the underlying portion of the protrusion 190 over which the tape 115-140 is applied. Thus, the tape 115-140 provides a reflective surface that is reactive to light from a wide range of angles of incidence impacting the protrusion 190 from either side 101, 102. Thus, the tape provides a retro-reflective surface despite the slope of the median. Concomitantly, the tape provides a retro-reflective surface for vehicles approaching from either direction.

A plurality of anchor holes 145, 150, 155, 180, 185 for receiving screws for fastening the spline 195 to substrate (e.g., concrete) using appropriate fasteners (e.g., masonry screws) are provided along each flange. The holes 145, 150, 155, 180, 185 may be spaced apart a determined distance, e.g., 12 inches, measured from hole 145, 150, 155, 180, 185 centers. Other distances between hole 145, 150, 155, 180, 185 centers may be used without departing from the scope of the invention. On a flange with v-notches, the anchor holes 145, 150, 155, 180, 185 are provided between v-notches. On the opposite flange, the anchor holes 145, 150, 155, 180, 185 are provided at locations between the holes 145, 150, 155, 180, 185 on the notched flange. In this manner, the holes 145, 150, 155, 180, 185 on opposite flanges alternate along the longitudinal axis of the spline 195.

A pressure sensitive adhesive 205 with a removable backing is provided on the bottom of the spline 195 to hold the spline 195 in place during installation. The pressure sensitive adhesive 205 forms a bond when pressure is applied to marry the adhesive with the adherend. No solvent, water, or heat is needed to activate the adhesive. While any pressure sensitive adhesive useful for bonding to concrete may be used, adhesives with a butyl rubber elastomer and compatible tackifier are preferred. A peel away backing exposes the pressure sensitive adhesive 205 for bonding.

Figure 9:
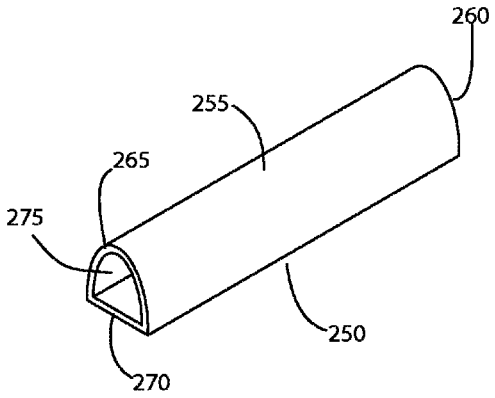
FIG. 9 is a perspective view of an exemplary male coupling for a continuous flexible retro-reflective roadway marking device according to principles of the invention; and Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

A coupling is provided to connect separate units of the marking device 100. By way of example and not limitation, a separate male D-shaped coupling, as shown in FIG. 9, engages and couples the female ends of abutting spline 195s. The D-shaped coupling includes a planar bottom surface 270, a curved top surface 255, a hollow central channel 275, a first end 260 and an opposite second end 270. The D-shaped coupling is shaped and sized to fit snugly into the D-shaped hollow opening of the protrusion 190. As an alternative to a D-shaped coupling, a properly sized thick walled semi-flexible elastomeric hose (e.g., a rubber hose) cut to a determined length (e.g., 6 inches) may serve as a male connector. The outer diameter of the hose should fit snugly within the channel 200 of the marking device. The coupling, thus, frictionally secures the separate units of the marking device 100. Optionally, a glue or bonding agent may be applied to permanently secure the coupling in the adjoined units. Other couplings, including, without limitation, snap fit connectors and integrally formed male and male and female couplings may be utilized within the scope of the invention. Alternatively, separate units of the marking device 100 may be adhered together using a glue or bonding agent. As another alternative, separate units of the marking device 100 may be located in abutting or adjacent relationship without coupling or adhering together.

The spline 195 and protrusion 190 of the marking device 100 can be made from high impact plastic, rubber, or other suitable material which will resiliently deflect upon contact with vehicle wheels without permanent damage. Thus, a vehicle should be able to ride over the protrusion 190 without destroying the marking device 100.

The protrusion 190 and spline 195 are not limited to any particular material, except that the chosen material should exhibit sufficient durability, flexibility and resiliency to serve as a marking device 100, withstand a vehicle and bend to conform to the shape of an intersection. In an exemplary embodiment plastic is used to form the protrusion 190 and spline 195, preferably a substantially strong, solid, yet lightweight material. By way of example and not limitation, the protrusion 190 and spline 195 may be comprised of high density polyethylene or polyvinyl chloride (PVC). However, other plastics may be used. Other exemplary plastics include rubber, recycled rubber, nylon, silicone, polysulfone, polyethylene, polypropylene, polystyrene, acrylics, cellulosics, acrylonitrile-butadiene-styrene terpolymers, urethanes, thermo-plastic resins, thermo-plastic elastomers (TPE), acetal resins, polyamides, polycarbonates and/or polyesters. Preferably the chosen material is relatively inexpensive, produces a durable, flexible and strong product, is easy to use in manufacturing operations and results in an aesthetically acceptable product. The material may further include additives to provide desired properties such as desired colors, structural characteristics, and phosphorescent or glow-in-the dark properties, and UV protection.

The protrusion 190 and spline 195 may be produced using any suitable manufacturing techniques known in the art for the chosen material, such as (for example) extrusion, injection, compression, structural foam, blow, or transfer molding; polyurethane foam processing techniques; vacuum forming; casting; machining; and milling. In a preferred embodiment, the spline 195 and protrusion 190 are integrally formed by extrusion. Then the retro-reflective tape 115-140 strips and adhesive are applied. Preferably the manufacturing techniques are suitable for mass production at relatively low cost per unit, and results in an aesthetically acceptable product with a consistent acceptable quality and structural characteristics.

Figure 5:
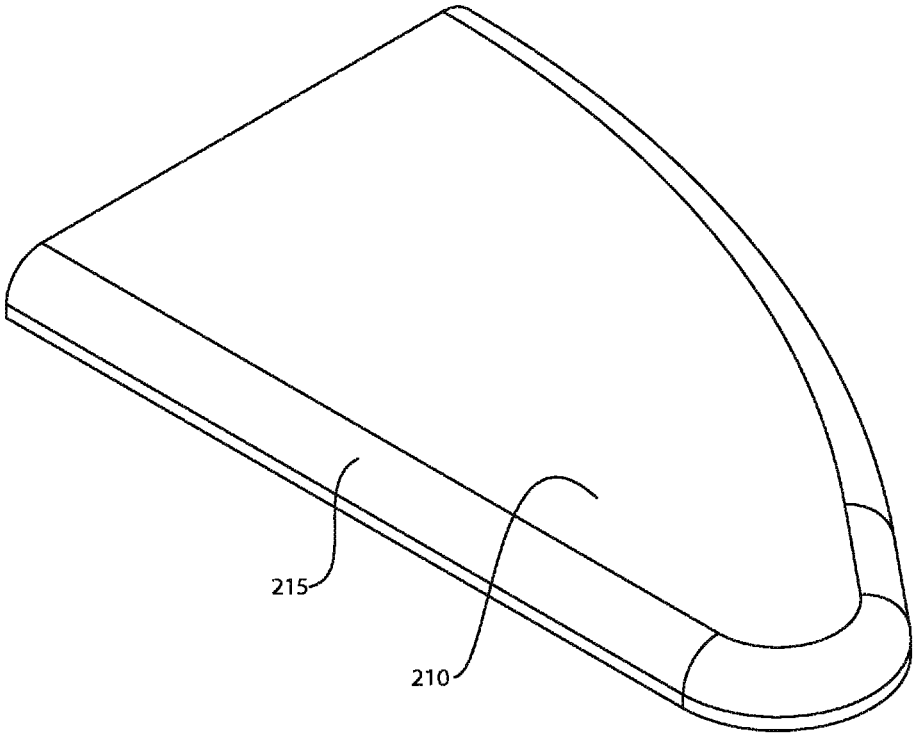
FIG. 5 is a perspective view of an exemplary median nose section of a roadway median suitable for receiving a continuous flexible retro-reflective roadway marking device according to principles of the invention.
Figure 6:
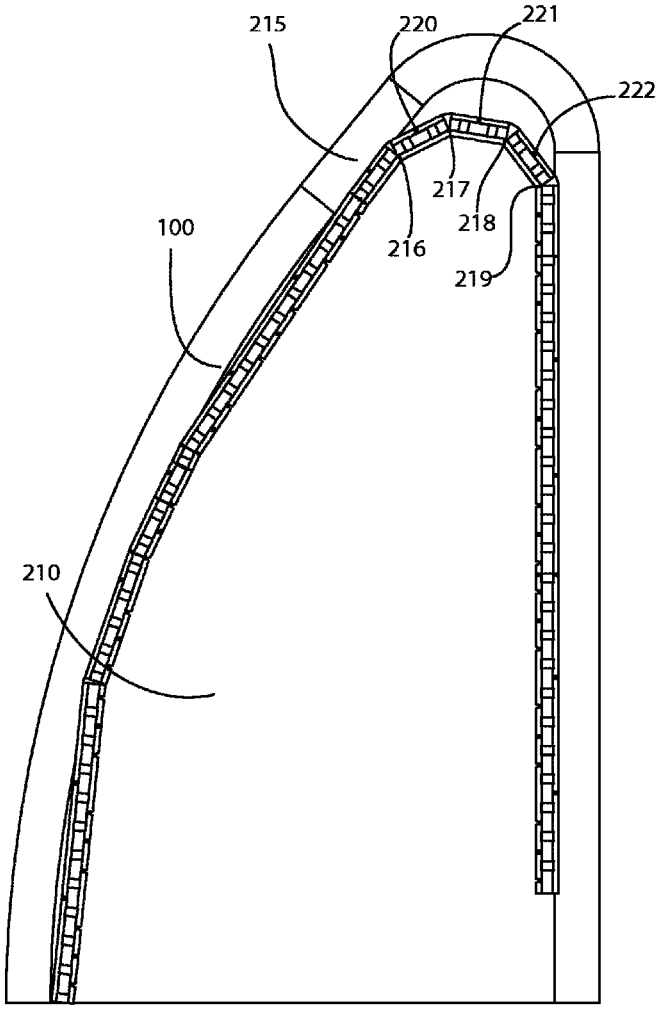
FIG. 6 is a plan view of an exemplary median nose section of a roadway median equipped with a continuous flexible retro-reflective roadway marking device according to principles of the invention.
Figure 7:
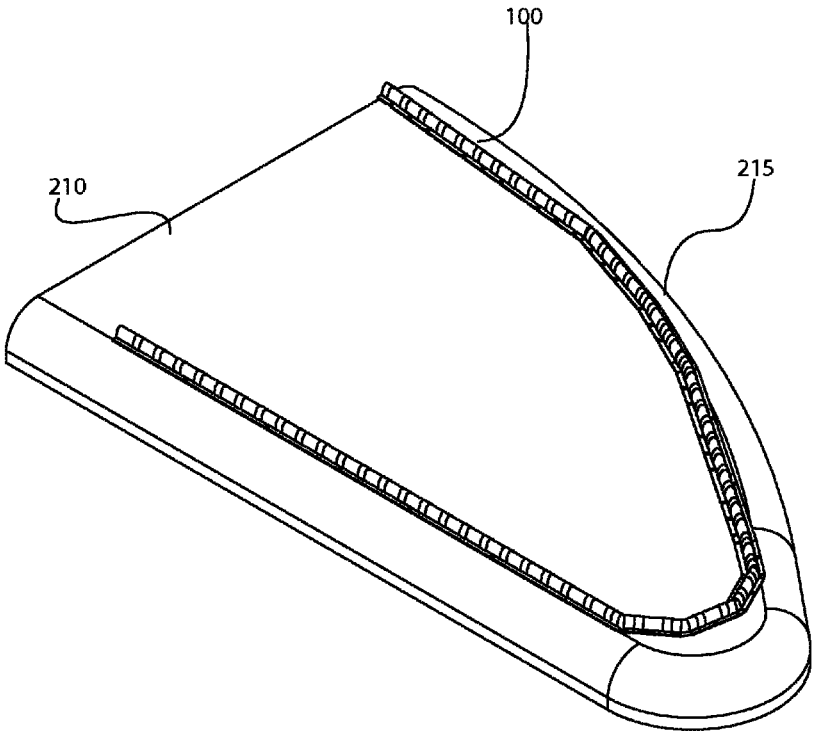
FIG. 7 is a first perspective view of an exemplary median nose section of a roadway median equipped with a continuous flexible retro-reflective roadway marking device according to principles of the invention.
Figure 8:
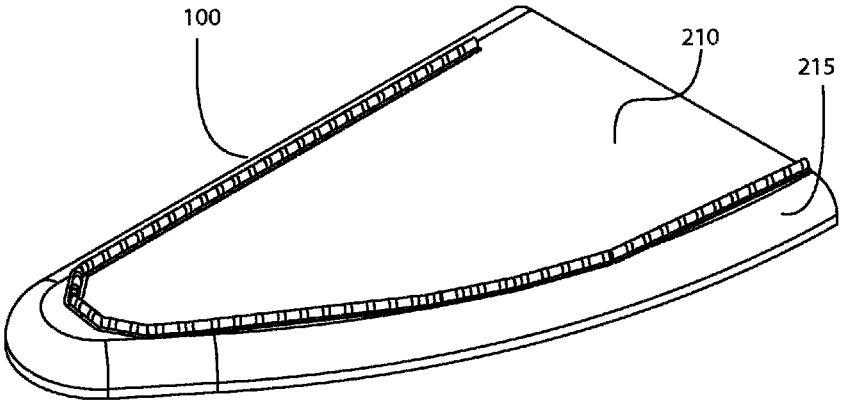
FIG. 8 is a second perspective view of an exemplary median nose section of a roadway median equipped with a continuous flexible retro-reflective roadway marking device according to principles of the invention.

FIG. 5 provides a perspective view of an exemplary median nose section 210 of a roadway median suitable for receiving a passive elongated flexible roadway marking device 100 according to principles of the invention. A curb 215 defines the perimeter of the median nose section 210. Several marking devices 100 according to principles of the invention may be attached to the top surface of the median nose 210 and bent to generally conform to the shape of the median nose 210 as conceptually illustrated in FIGS. 6, 7 and 8. While these drawings are not to scale, they help illustrate bending characteristics of a continuous flexible retro-reflective roadway marking device according to principles of the invention. The several marking devices may be coupled together using the male coupling described above. With reference to FIG. 6, notches 216-219 of the segments at the leading edge are shown in a collapsed configuration, to facilitate bending to conform to the shape of the median nose. Attachment holes 220-222 allow the segments to be securely fastened to the median.

While the marking device 100 is shown attached to the top surface of the median, it is not so limited. Rather, the marking device 100 may be attached to the curb of the median, such as near the top surface. The flexibility of the device 100 permits such use.

The marking device 100 will be visible to a vehicle approaching the median 210 from any traffic direction. The retro-reflective elements 115-140 of the marking device 100 will reflect light emitted from headlamps of such vehicles no matter what the angle of incidence may be.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A flexible marking device for a roadway, said device comprising:

an elongated spline having a first side, an opposite second side, a first end and an opposite second end, a top surface and an opposite bottom surface, a spline length from the first end to the second end, a spline width from the first side to the second side, and spline thickness from the top surface to the bottom surface;

a protrusion attached to the top surface of the spline, said protrusion having an outer surface, a profile shape, a protrusion length, a protrusion width and a protrusion height, the protrusion width being less than the spline width and the protrusion height being at least ½ inch;

said spline further including a first flange coextensive with the first side and a second flange coextensive with the second side, and said protrusion being attached to the spline between the first flange and the second flange;

a plurality of spaced apart notches in the first flange, said notches facilitating bending of the device, each of the plurality of spaced apart notches comprising a v-shaped notch with a circular stress relief vertex, said second flange being devoid of said notches;

a plurality of spaced apart attachment holes in the first flange and the second flange, the holes in the first flange being spaced apart and located between the spaced apart notches in the first flange, and the holes in the second flange being spaced apart and located in the second flange at locations in the second flange between the holes in the first flange; and a plurality of spaced apart retro-reflective elements attached to the outer surface of the protrusion; each of the retro-reflective elements covering a portion of the protrusion from about the first flange to the second flange; and a pressure sensitive roadway attaching adhesive attached to the bottom surface of the spline.

2. The flexible marking device for a roadway according to claim 1, the plurality of spaced apart retro-reflective elements comprising retro-reflective tape strips.

3. The flexible marking device for a roadway according to claim 2, each retro-reflective tape strip having a width of at least about ½ inch.

4. The flexible marking device for a roadway according to claim 2, each retro-reflective tape strip being an abrasion resistant retro-reflective tape strip.

5. The flexible marking device for a roadway according to claim 1 each v-shaped notch with a circular stress relief vertex defining an acute angle opening.

6. The flexible marking device for a roadway according to claim 1, the profile shape being D-shaped.

7. The flexible marking device for a roadway according to claim 6, the D-shaped profile including a semicircular profile portion attached to a straight profile portion.

8. The flexible marking device for a roadway according to claim 1, the pressure sensitive roadway attaching adhesive attached to the bottom surface of the spline comprising a butyl rubber elastomer, tackifier and peel away backing.

9. The flexible marking device for a roadway according to claim 1, the spline width being at least 1.5 inches.

10. The flexible marking device for a roadway according to claim 8, the protrusion width being at least 1 inch.

11. The flexible marking device for a roadway according to claim 8, the protrusion height being at least 1 inch.

12. The flexible marking device for a roadway according to claim 1, the protrusion and spline being integrally formed.

13. The flexible marking device for a roadway according to claim 1, the protrusion and spline being an integrally formed plastic extrusion.

14. The flexible marking device for a roadway according to claim 1, the protrusion being hollow, a channel extending through the protrusion, and a male connector shaped and sized to extend into the channel and frictionally engage the protrusion.

15. A flexible marking device attached to a roadway median having a curved end, said roadway median being disposed between lanes of travel, and said marking device comprising:

an elongated spline having a first side, an opposite second side, a first end and an opposite second end, a top surface and an opposite bottom surface, a spline length from the first end to the second end, a spline width from the first side to the second side, and spline thickness from the top surface to the bottom surface;

a protrusion attached to the top surface of the spline, said protrusion having an outer surface, a profile shape, a protrusion length, a protrusion width and a protrusion height, the protrusion width being less than the spline width and the protrusion height being at least ½ inch;

said spline further including a first flange coextensive with the first side and a second flange coextensive with the second side, and said protrusion being attached to the spline between the first flange and the second flange;

a plurality of spaced apart notches in the first flange, said notches facilitating bending of the device, each of the plurality of spaced apart notches comprising a v-shaped notch with a circular stress relief vertex, said second flange being devoid of said notches;

a plurality of spaced apart attachment holes in the first flange and the second flange, the holes in the first flange being spaced apart and located between the spaced apart notches in the first flange, and the holes in the second flange being spaced apart and located in the second flange at locations in the second flange between the holes in the first flange; and a plurality of spaced apart retro-reflective elements attached to the outer surface of the protrusion; each of the retro-reflective elements covering a portion of the protrusion from about the first flange to the second flange; and a pressure sensitive roadway attaching adhesive attached to the bottom surface of the spline; and said marking device being securedly attached to the roadway median adjacent to the curved end of the roadway median and being bent to generally conform to the shape of curved end of the roadway median.

16. The marking device attached to a roadway median according to claim 15, the plurality of spaced apart retro-reflective elements comprising abrasion resistant retro-reflective tape strips, each retro-reflective tape strip having a width of at least about ½ inch.

17. The marking device attached to a roadway median according to claim 16, each v-shaped notch with a stress relief vertex defining an acute angle opening.

18. The marking device attached to a roadway median according to claim 17, said pressure sensitive roadway attaching adhesive attached to the bottom surface of the spline attaching the device to the roadway median, and further comprising a plurality of screws, said plurality of screws securing the spline to the roadway median through the attachment holes.

* * * * *